United States Patent [19]

Kasuya et al.

[11] Patent Number: 4,961,091

[45] Date of Patent: Oct. 2, 1990

[54] SHEET RECEIVING DEVICE

[75] Inventors: Michio Kasuya, Chofu; Akihiro Tomoda, Yokohama, both of Japan

[73] Assignee: Canon Kabushiki Kaisha, Tokyo, Japan

[21] Appl. No.: 304,481

[22] Filed: Feb. 1, 1989

[30] Foreign Application Priority Data

Feb. 2, 1988 [JP] Japan ..... 63-22455
Feb. 2, 1988 [JP] Japan ..... 63-22456
Nov. 25, 1988 [JP] Japan ..... 63-299071

[51] Int. Cl.[5] ..... B65H 31/00; G03G 15/00
[52] U.S. Cl. ..... 355/321; 271/207
[58] Field of Search ..... 271/186, 207, 220; 355/72, 75, 76, 202, 315, 321, 322, 324

[56] References Cited

U.S. PATENT DOCUMENTS 4,502,805 3/1985 Humbs ..... 271/220 X

FOREIGN PATENT DOCUMENTS 36261 2/1985 Japan ..... 271/207
166463 7/1986 Japan ..... 271/220

*Primary Examiner*—Donald A. Griffin
*Attorney, Agent, or Firm*—Fitzpatrick, Cella, Harper & Scinto

[57] ABSTRACT

A sheet receiving device has conveying means for conveying a sheet, restraining means disposed downstream of the conveying means with respect to the direction of conveyance by a distance shorter than the length of th esheet in th edirection of conveyance for restraining the leading end edge of the sheet being conveyed, first guide means for guiding the sheet to the restraining means, second guide means cooperating with the first guide means to hold the sheet therebetween, and support means for movably supporting at least one of the first guide means and the second guide means so that the distance between the first guide means and the second guide means can increase with the sheet held therebetween, in conformity with an increase in the sheet held between the first guide means and the second guide means.

23 Claims, 8 Drawing Sheets

SHEET RECEIVING DEVICE

BACKGROUND OF THE INVENTION

1. Field of the Invention

This invention relates to a sheet receiving device for use in an image forming apparatus such as a copying apparatus or a facsimile apparatus, and more particularly to a sheet receiving device for receiving sheets discharged from an image forming apparatus.

2. Related Background Art

A sheet receiving device for recording sheets having images already formed thereon which is installed on a facsimile apparatus, a copying apparatus or the like is usually provided in a projected form as a recording sheet receiving tray on the apparatus body. An example of the facsimile apparatus provided with such a recording sheet receiving tray is shown in FIG. 2 of the accompanying drawings.

In FIG. 2, the reference numeral 1 designates a facsimile apparatus body provided with an information reading and transmitting system for reading the information of an original 3 fed on an original supporting table 2 by a reading unit 4 designed to convert said information into an electrical signal by a photoelectic conversion element 4*c* such as a CCD through the intermediary of mirrors 4*a* and 4*b* and transmitting said information, and an information receiving and recording system having a recording head 8 for recording the received information on a recording sheet 7 paid away from a recording paper roll 5 by a platen roller 6.

In FIG. 2, an original receiving tray 9 for receiving the original 3 fed out from the original supporting table 2 is provided on the left-hand side of the facsimile apparatus body 1, and a recording sheet receiving tray 11 for receiving a recording sheet 7 having an image already formed thereon by the recording head 8 and cut into a predetermined length by a cutter 10 is projectedly provided on the right-hand side of the facsimile apparatus body 1. The reference numeral 12 denotes a power source unit including a power source device, etc.

In recording apparatuses such as facsimile apparatuses, compactness and light weight thereof are strongly required. However, in the aforedescribed recording apparatus, the original receiving tray 9 and the recording sheet receiving tray 11 are projected on the opposite sides of the facsimile apparatus body 1 and therefore, even if the apparatus body 1 is made compact, these projected trays prevent the actual installment space from being made very small.

As a means for solving this problem, it would be conceivable to arrange the trays on one side of the apparatus body and thereby to omit the space for one tray. However, if the trays are concentrated on one side of the apparatus body, the drive systems for the information reading and transmitting system and the information receiving and recording system will also be concentrated on that side and as a result, the space efficiency of the interior of the apparatus will be hindered and the drive systems will be complicated. This may lead to reduced reliability, and further to increased costs.

Also, in the aforedescribed prior-art recording apparatus, recording sheets having images already formed thereon are discharged from the apparatus with their recording surfaces facing upward and are successively piled. Thus, when a plurality of pages of originals are to be recorded, recording sheets having images already formed thereon which are discharged from the apparatus are piled with the first page lying at the bottom and the second and subsequent pages successively lying thereon, and this order of piling is converse to the order of the originals. Therefore, after the completion of the recording operation, it is necessary to rearrange the recording sheets having images already formed thereon in the order from the first page, and this is a very time-consuming work.

Further, a sheet wound into the form of a roll such as a recording sheet used in a facsimile apparatus or the like has a strong curl and is difficult to receive in good order on a straight tray surface as is conventional. Recently, there is the tendency to make the outer diameter of the roll as small as possible without changing the length of the sheet, in conformity with the compactness of the apparatus body, and as a means therefor, there is adopted a method of making the winding core small in diameter. As a result, the curl becomes more remarkable and the development of a method of receiving recording sheets after image formation which will well cope therewith is desired.

So, to solve these problems, the applicant invented and proposed a recording sheet receiving tray as shown in FIG. 3 of the acompanying drawings (U.S. Pat. No. 4,768,063).

In FIG. 3, a recording sheet receiving tray 13 is provided below and near the recording sheet outlet of a facsimile apparatus 1, and this tray is constituted by an outer tray 14 as a first guide member against which a recording sheet 7 after having an image already formed thereon bears and which guides this recording sheet downwardly, and an inner tray 15 as a second guide member for forming a recording sheet receiving space 16 in opposed relationship with the outer tray 14.

The lower end portion of the outer tray 14 is connected to the lower end portion of the inner tray 15 by a pin 17, and the outer tray 14 is pivotally supported about the pin 17. The outer tray 14 is restrained relative to the apparatus body 1 by a click mechanism, not shown, and is normally held in its closed position.

The outer tray 14 is provided with a plurality of ribs 18 so that the contact resistance thereof with the leading end edge of the recording sheet 7 may be reduced and the recording sheet may be smoothly guided to the receiving space 16 of the recording sheet receiving tray 13. Also, a v-shaped gripping portion for gripping the leading end edge of the recording sheet 7 is formed by the outer tray 14 and the inner tray 15. Further, at the upper end of the outer tray 14 in its closed position, an open portion 20 is provided so that the trailing end edge of the recording sheet 7 can be reversed in the form of a loop and the recording sheet can be discharged outwardly when a long recording sheet 7 is received.

However, the force with which the V-shaped gripping portion 19 grips the leading end edge of the recording sheet 7 has been limited, and such tray has been unsuitable for receiving a number of recording sheets. Further, during the reception of a remarkably long recording sheet, there has been the problem that the sheet slips down from the tray.

So, to solve these problems, Applicant proposes in Japanese Patent Application Laid-Open No. 63-218463 a recording sheet contraction tray as shown in FIG. 4 of the accompanying drawings.

This solving means is characterized by the provision of a first guide member 14 for downwardly guiding the leading end edge of a recording sheet having an image recorded thereon by a recording unit, a second guide member 15 for forming a recording sheet receiving space in opposed relationship with said first guide member, an open portion 20 at the upper end of said first guide member for permitting the reversal of the trailing end edge of the recording sheet, a pair of discharge rollers comprising a discharge roller 28 provided on the recording sheet discharge portion side of the recording apparatus and driven and a pinch roller 29 provided in opposed relationship with said discharge roller, a rotatable grip roller 33 provided in said receiving space, and a pressing plate 30 provided in said receiving space for gripping the leading end edge of the recording sheet fed downwardly.

Thus, when the recording sheet discharged from the image forming unit of the recording apparatus is to be received onto the recording sheet receiving tray, the recording sheet having an image already formed thereon which is paid away from the pair of discharge rollers 28 and 29 in the discharge portion has its leading end edge bearing against the first guide member 14 and is guided downwardly into the receiving space for the recording sheet.

The leading end edge of the recording sheet which has come into the sheet receiving space is caught by the grip roller 33 and fed downwardly and gripped by a gripping portion, whereafter it bears against the bottom of the tray and its forward movement is stopped.

When image recording is going on, the recording sheet still continues to be discharged, and is discharged in the form of a loop from the apparatus body by the rotation of the pair of discharge rollers. On the other hand, when image recording is completed and the recording sheet is cut by a cutter, the trailing end portion of the recording sheet hangs down outside the apparatus body by its gravity. Since at this time, the leading end edge of the recording sheet is gripped or nipped by the gripping portion, the recording sheet will never slip down from the apparatus body.

However, the gap between the outer tray 14 and the grip roller 33 or the outer tray and the pressing plate 30 for gripping the recording sheet 7 is of a certain predetermined value, and as a matter of course, the number of recording sheets 7 gripped has been limited.

SUMMARY OF THE INVENTION

It is an object of the present invention to provide a sheet receiving device which can receive a great quantity of recording sheets.

It is another object of the present invention to widen the gap between a grip roller or a pressing plate and an outer tray in proportion to the number of recording sheets received and enable a great quantity of recording sheets to be received.

DESCRIPTION OF THE PREFERRED EMBODIMENTS

Figure 1:
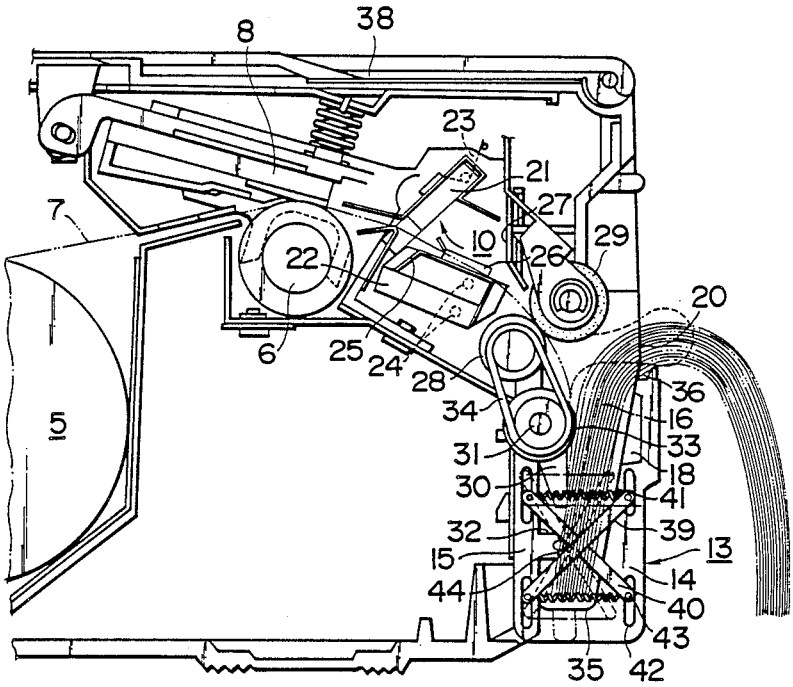
FIG. 1 is a cross-sectional view showing a first embodiment of the present invention.
Figure 2:
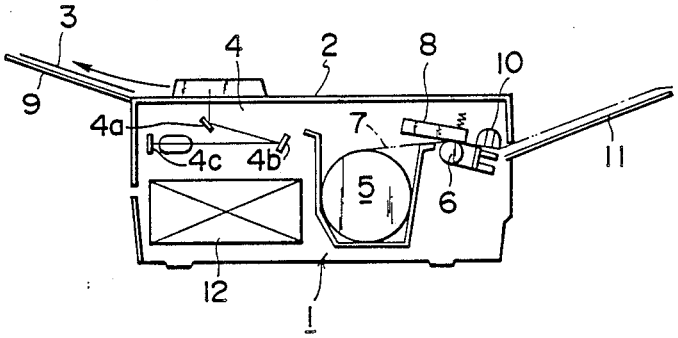
FIGS. 2, 3 and 4 are schematic views of a facsimile apparatus according to the prior art.
Figure 3:
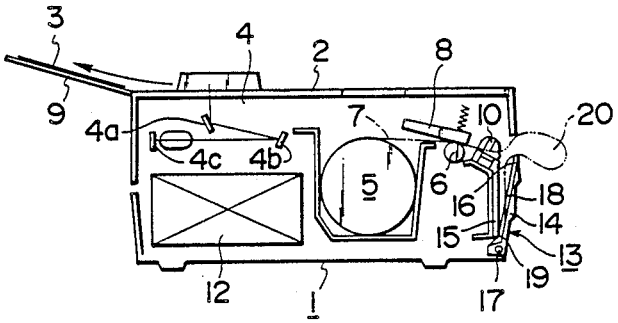
Figure 4:
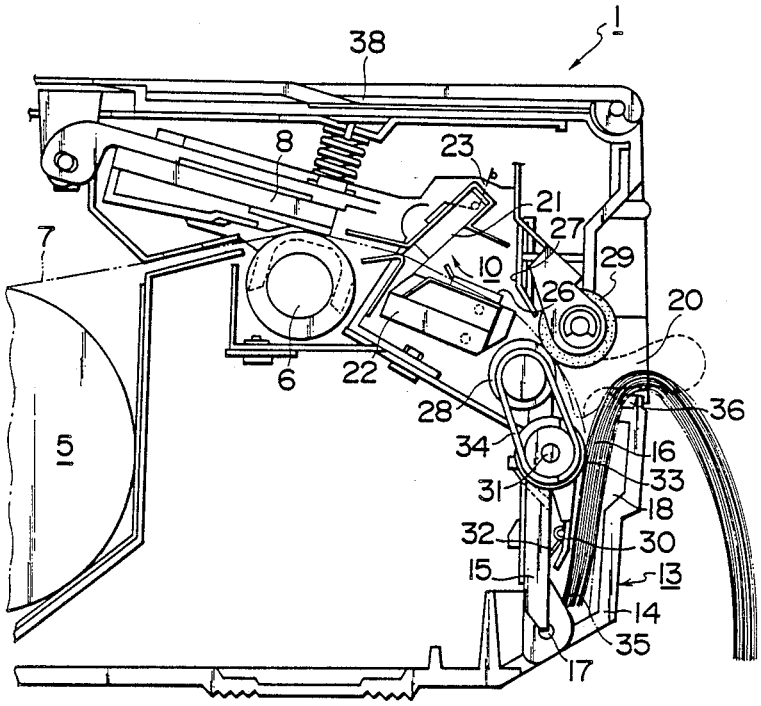

Some embodiments of the present invention will hereinafter be described with reference to the drawings in which portions similar to those of the embodiment of the prior art are given similar reference numerals.

FIG. 1 illustrates the present invention as it is applied to a facsimile apparatus.

In FIG. 1, a recording sheet 7 discharged away from a recording sheet roll 5 is introduced into a recording unit comprising a platen roller 6 and a recording head 8. The recording sheet 7 having an image formed thereon in the recording unit is directed to a cutter 10 comprising a biasing edge 21 and a rotatable cutting edge 22.

The biasing edge 21 is biased toward the rotatable cutting edge 22 by a biasing spring 23. The rotatable cutting edge 22 is provided on the apparatus body 1 for rotation about shafts 24 with a predetermined inclination with respect to the edge surface of the biasing edge 21. The rotatable cutting edge 22 is driven in synchronism with the recording operation of the recording unit by a driving device, not shown.

A cutting edge cover 25 is provided on that surface of the rotatable cutting edge 22 over which the recording sheet 7 passes. The cutting edge cover 25 covers a gap formed by the edge surfaces of the rotatable cutting edge 22 and the biasing edge 21 because the rotatable cutting edge 22 is inclined at a predetermined angle with respect to the biasing edge 21, so that for example, the operator's hand may not come into the gap. A guide cover 26 is attached to the cutting edge cover 25 as by spot welding. The guide cover 26 is provided over the full length of the cutting edge cover 25, and opens in its longitudinal direction relative to the direction of passage of the recording sheet 7. That side of the guide cover 26 which is adjacent to the recording unit is bent so that the recording sheet 7 can be readily introduced.

A recording base plate 27 is designed to direct the leading end edge of the recording sheet 7 toward a discharge roller 28 and a pinch roller 29 driven while being urged against the discharge roller 28 which together constitute a pair of discharge rollers. The discharge roller 28 is driven at the same peripheral speed as that of the platen roller 6 by a driving device, not shown.

An outer tray 14 as a first guide member is provided with a plurality of ribs 18. Further, the outer tray 14, together with an inner tray 15 as a second guide member, constitutes a receiving space 16. In the receiving space 16, a pressing plate 30 for gripping the leading end edge of the recording sheet 7 is pivotally supported on a shaft 31 provided on the inner tray 15 side, and the pressing plate 30 is biased toward the outer tray 14 side by a pressing spring 32. Thus, the recording sheet 7 may be gripped by the surface of the pressing plate 30 and the ribs 18. The surface of the pressing plate 30 is coated with resin or the like having a low coefficient of friction to reduce the resistance when the leading end edge of the recording sheet 7 comes in.

A grip or nip roller 33 is provided in the receiving space 16, and this grip roller 33 receives the drive force of the discharge roller 28 by means of a grip belt 34 and is rotated about the shaft 31. The surface of the grip roller 33 is knurled so as to be capable of reliably gripping the surface of the recording sheet 7. The grip roller 33 is formed with a gap between it and the ribs 18. The reference numeral 35 designates the bottom of the receiving space 16.

The operation of the recording apparatus constructed as described above will now be described.

The recording sheet roll 5 wound into the form of a roll is unwound from its leading end and is supplied to extend between the platen roller 6 and the recording head 8. The recording sheet 7 has an image formed on its surface by the recording head 8, and is transported as the platen roller 6 is rotated. The leading end edge of the recording sheet passes between the biasing edge 21 and the rotatable cutting edge 22 which together constitute the cutter 10, and passes between the cutting edge cover 25 and the guide cover 26 and bears against the recording base plate 27. The leading end edge of the recording sheet is directed to the pair of discharge rollers by the recording base plate 27, and is discharged while being held between the discharge roller 28 and the pinch roller 29.

The leading end edge of the recording sheet 7 discharged by the pair of discharge rollers 28 and 29 comes to below the receiving space 16, whereafter it is gripped by the pressing plate 30 and the ribs 18. When the number of recording sheets 7 gripped is small, the recording sheet is gripped by the pressing plate 30, but when the number of recording sheets piled increases, the recording sheet 7 is held by the grip roller 33 and the ribs 18. When the leading end edge of the recording sheet 7 bears against the bottom 35, the recording sheet 7 stops advancing into the receiving space 16.

If the formation of an image on the recording sheet 7 is going on in the recording unit when the leading end edge of the recording sheet 7 bears against the bottom 35 and stops advancing into the receiving space 16, the recording sheet 7 still continues to be discharged by the pair of discharge rollers 28 and 29. In such a case, the recording sheet 7 is discharged in the form of a loop out of the apparatus body 1 through an open portion 20 formed at the upper end of the outer tray 14.

After the formation of the image is completed and the recording sheet 7 is cut by the cutter 10, the pair of discharge rollers continue to rotate and the trailing end edge of the recording sheet 7 is discharged from the pair of discharge rollers 28 and 29. The recording sheet 7 hangs down outside the outer tray 14 by the gravity of the portion thereof discharged in the form of a loop while the leading end edge thereof remains gripped by the pressing plate 30, and the succeeding recording sheets 7 likewise hang down outside the outer tray 14, whereby the recording sheets are piled in the receiving space 16.

Further, in proportion to the quantity of recording sheets 7 piled, the outer tray 14 moves from the dots-and-dash line position to the solid line position to widen the gap between the grip roller 33 and the ribs 18 and provide a wider receiving space. The movement of the outer tray 14 is effected substantially in parallelism to the inner tray 15 by link levers 39 and 40 pivotally supported by a fulcrum 44 while being subjected to the biasing forces of tension springs 41 and 42.

A second embodiment of the present invention will now be described. In the second embodiment, portions similar to those of the first embodiment are given similar reference numerals and need not be described.

Figure 5:
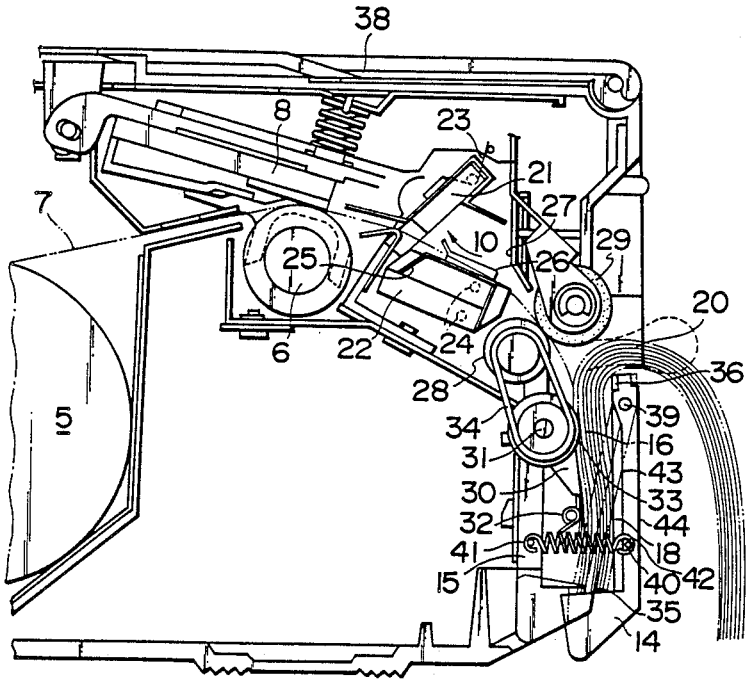
FIG. 5 is a cross-sectional view showing a second embodiment of the present invention.

Referring to FIG. 5, an outer tray 14 is mounted for pivotal movement about a pivot shaft 39.

By the outer tray 14 rotating from the dots-and-dash line position 43 of FIG. 5 to the solid line position 44, the gap between a grip roller 33 and ribs 18 is widened, whereby a receiving space for the recording sheet 7 is secured. A spring 42 is hooked between a pin 41 attached to an inner tray 15 and a pin 40 attached to the outer tray 14, and serves to normally bias the outer tray 14 relative to the inner tray 15.

In the other points, the second embodiment is of the same construction as the first embodiment except for a slip-down preventing member 36 and an upper case 38 which will be described later.

The operation of the second embodiment will now be described.

A recording sheet roll 5 wound into the form of a roll is rewound from its leading end and is supplied to a position between a platen roller 6 and a recording head 8. The recording sheet 7 has an image formed on its surface by the recording head 8, and is transported as the platen roller 6 is rotated. The leading end edge of the recording sheet passes between a biasing edge 21 and a rotatable cutting edge 22 which together constitute a cutter 10, and further passes between a cutting edge cover 25 and a guide cover 26 and bears against a recording base plate 27. The leading edge of the recording sheet is directed to a pair of discharge rollers by the recording base plate 27 and the recording sheet is discharged while being held between the discharge roller 28 and the pinch roller 29.

The leading end edge of the recording sheet 7 discharged from the pair of discharge rollers 28 and 29 comes to a position below the receiving space 16, whereafter it is gripped by a pressing plate 30 and the ribs 18. When the number of recording sheets 7 to be gripped is small, the recording sheets are gripped by the pressing plate 30, but when the number of recording sheets piled increases, the gap between the grip roller 33 and the ribs 18 becomes null and the recording sheet 7 is held by the grip roller 33 and the ribs 18.

At this time, the outer tray 14 rotates about the pivot shaft 39 and progressively widens the gap. Also, the spring 42 hooked between the inner tray 15 and the outer tray 14 is strengthened in proportion to the number of recording sheets 7 piled. Also, as the outer tray 14 rotates, the upper end portion thereof comes more toward the inner tray 15, whereby the piled recording sheets 7 become substantially vertically upright. Accordingly, it becomes difficult for the recording sheets to fall.

The leading end edge of the recording sheet 7 introduced, into the receiving space 16 this manner stops moving in when it bears against the bottom 35. If the formation of an image on the recording sheet 7 is going on in the recording unit when the leading end edge of the recording sheet 7 bears against the bottom 35 and stops moving into the receiving space 16, the recording sheet 7 still continues to be discharged from the pair of discharge rollers 28 and 29. In such a case, the recording sheet 7 is discharged in the form of a loop outwardly of the apparatus body 1 through an open portion 20 formed at the upper end of the outer tray 14.

After the formation of the image is completed and the recording sheet 7 is cut by the cutter 10, the pair of discharge rollers continue to rotate and the trailing end edge of the recording sheet 7 is discharged from the pair of discharge rollers 28 and 29. The recording sheet 7 hangs down outside the outer tray 14 by the gravity of the portion thereof discharged in the form of a loop with its leading end edge remaining gripped by the pressing plate, and the succeeding recording sheets 7 likewise hang down outside the outer tray 14, whereby they are piled in the receiving space 16.

The reference numeral 36 designates a slip-down preventing member such as a rubber piece provided on the upper portion of the outer tray 14. This slip-down preventing member 36 prevents the first recording sheet 7 from slipping up and falling off out of the recording sheet receiving tray when the recording sheets 7 are piled in the receiving space 16.

The reference numeral 38 denotes an upper case in which the recording head 8, the recording base plate 27 and the pinch roller 29 are provided. By opening the upper case 38, the platen roller 6, the cutter 10 and the discharge roller 28 become exposed, and this is advantageous for the interchange of the recording sheet roll 5.

Figure 6:
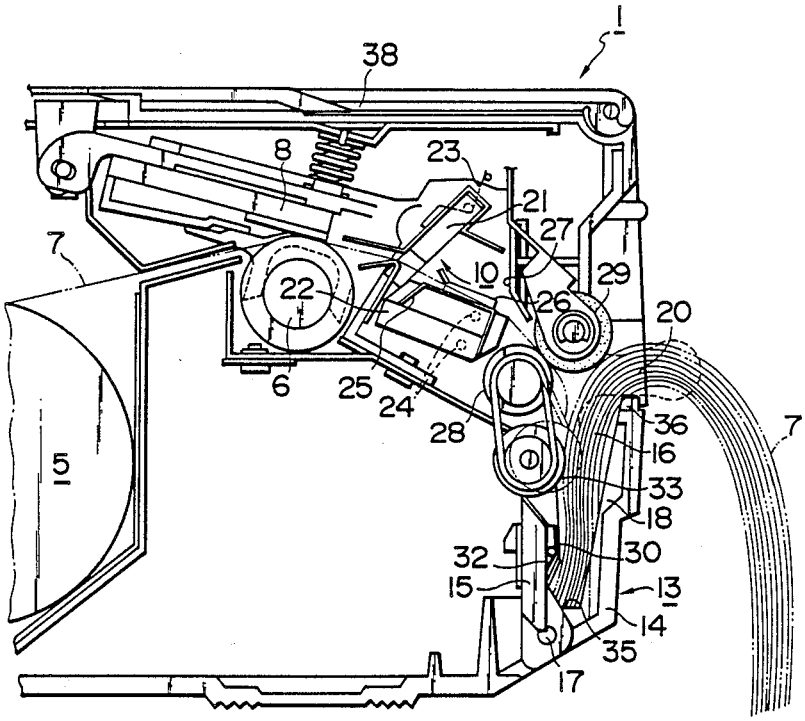
FIG. 6 is a cross-sectional view showing a third embodiment of the present invention.

FIG. 6 shows a third embodiment of the present invention. In FIG. 6, the grip roller 33 is supported for pivotal movement about the rotary shaft of the discharge roller 28. The grip roller 33 progressively moves from the dots-and-dash line position of FIG. 6 to the solid line position in proportion to the quantity of recording sheets 7 piled, and widens the gap between the grip roller 33 and the ribs 18 to thereby provide a wider receiving space. The outer tray 14 supported for pivotal movement about a pin 17 is restrained relative to the apparatus body 1 by a click mechanism, not shown, and is normally held in its closed position.

Portions similar to those described previously are given similar reference numerals and need not be described.

Still another embodiment of the present invention will now be described.

Figure 7:
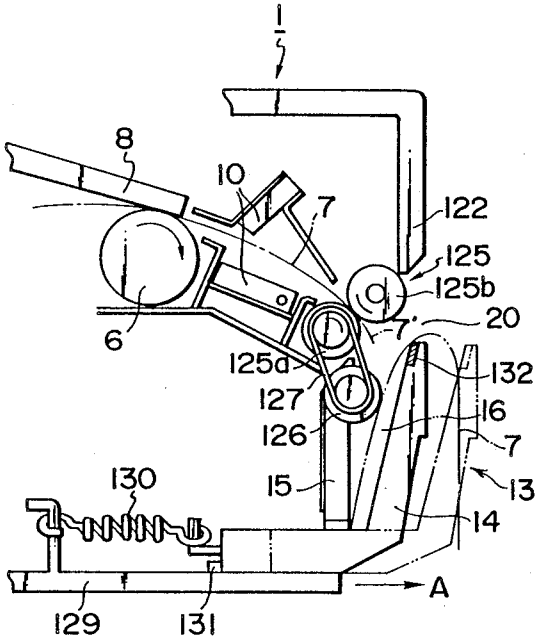
FIG. 7 is a cross-sectional view showing a fourth embodiment of the present invention.

A facsimile apparatus 1, as shown in FIG. 7, has a pair of discharge rollers 125 downstream of a cutter 10, said pair of discharge rollers 125 being constituted by a drive roller 125*a* connected to a motor (not shown), and a pinch roller 125*b* biased toward the roller 125*a* by a spring (not shown). Below the pair of rollers 125, a grip roller 126 is supported by a second guide 15, and the drive is designed to be transmitted from the drive roller 125*a* to the grip roller 126 through a belt 127. A first guide member 14 is slidably supported by a machine body frame 129 and is connected to a spring 130 having one end thereof fixed to the frame 129, whereby it is biased toward the second guide member 15.

Designated by 131 in FIG. 7 is a stopper for controlling the position of the first guide member 14 relative to the second guide member 15, and denoted by 132 is a frictional piece for preventing the sheet from slipping up.

The present embodiment is of the construction as described above and therefore, when the recording sheet 7 put away from the recording sheet roll 5 and having image information recorded there-on by the thermal head 8 in conformity with original information is to be received in the sheet receiving tray 13, the recording sheet 7 is conveyed by the rotation of the platen roller 6, passes the cutter 10 and is discharged into the sheet receiving tray 13 by the pair of discharge rollers 125. When the recording sheet 7 arrives at the position of the first guide member 14, the leading end edge 7′ thereof bears against the guide member 14 at an obtuse angle and is guided downwardly into the receiving space 16.

When the leading end edge 7′ of the recording sheet 7 arrives at the lower end of the receiving space 16, the forward movement thereof is stopped, but since usually the length of the recording sheet is greater than the distance from the pair of discharge rollers 125 to the lower end of the receiving space 16, the trailing end edge of the recording sheet 7 still continues to be discharged by the pair of discharge rollers 125 and forms a loop, and this is expedited by the rotation of the pinch roller 125, whereby the recording sheet is discharged out of the apparatus through the open portion 20. At this time, the leading end edge 7′ of the recording sheet is gripped by the grip roller 126 and the first guide member 14 and the recording sheet 7 is subjected to a frictional force by the frictional piece 132 provided at the upper end of the first guided member 14 and therefore, the lower portion of the loop does not slip up, but only the upper portion of the loop is discharged with the rotation of the pinch roller 125*b*.

When the recording on the recording sheet 7 by the thermal head 8 is completed, the trailing end of the recording sheet 7 is cut by the rotation of the cutter 10, but the pair of discharge rollers 125 continue to rotate and the trailing end edge of the recording sheet 7 is reliably reversed and discharged out of the apparatus by the rotating pinch roller 125*b*. Again at this time, the recording sheet 7 is about to slip off from by its gravity, but the slip-off is prevented by the gripping of the leading end edge 7′ of the recording sheet by the grip roller 126 and the first guide member 14 and the resistance of the frictional piece 32.

Each time a recording sheet 7 is received in the sheet receiving tray 13 by a similar operation, the first guide member 14 moves little bY little in the direction of substantially horizontal arrow A by an amount corresponding to the thickness of the recording sheet 7 against the force of the spring 130, and recording sheets 7 corresponding to the length of a recording sheet roll 5 are received in the sheet receiving space 16. In this case, the spring 130 is within a range which does not exceed the limit of resiliency, and the spring force of the spring 130 is determined by an experiment to such a proper value that it is not too strong for the sheet receiving space 16 to widen readily and cause the recording sheet 7 to be jammed or not too weak to grip the recording sheet 7 and cause it to fall.

Figure 8:
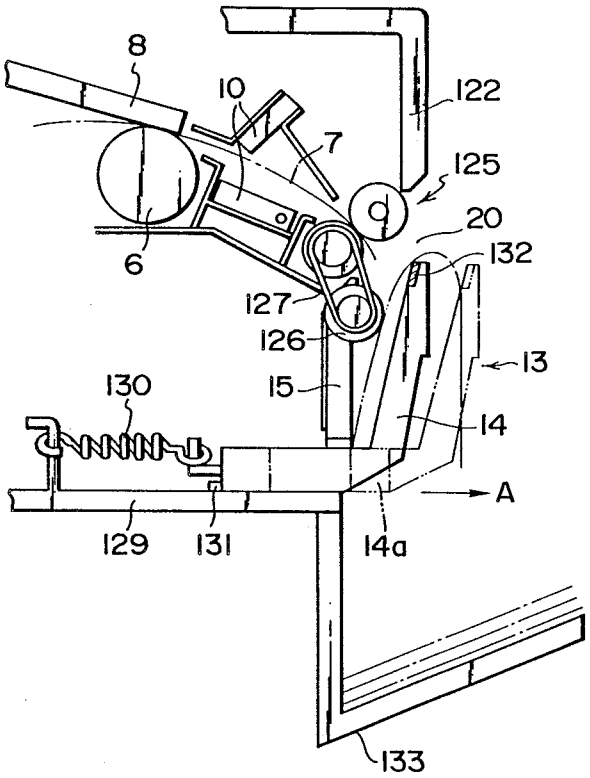
FIGS. 8, 9,, 10, 11 and 12 are cross-sectional views showing further embodiments of the present invention.

In the above-described embodiment, the spring 130 is chosen so that recording sheets 7 corresponding to a recording sheet roll 5 can be received in the sheet receiving tray 13, whereas this is not restrictive, but as shown in FIG. 8, the spring 130 may be chosen so that recording sheets 7 corresponding to a fraction of a recording sheet roll 5 can be received in the sheet receiving tray 13. Where this is adopted, an auxiliary tray 133 is disposed below the sheet receiving tray 13, and each time recording sheets 7 corresponding to a fraction of a recording sheet roll 5 are received in the sheet receiving tray 13 (the amount thus received may be known as by detecting the remaining amount of the roll 5), the first guide member 14 is greatly moved in the direction of arrow A by unshown drive means (which may be a plunger or the like driven by the remaining amount detection signal) and the recording sheet 7 is caused to fall into the auxiliary tray 133 from an opening portion 14*a* provided in the horizontal portion of the guide member 14 and is received therein. After the recording sheet 7 is caused to fall from the sheet receiving tray 13 into the auxiliary tray 133 and is received therein, the first guide member 14 is returned to a position indicated by solid line, by drive means.

Figure 9:
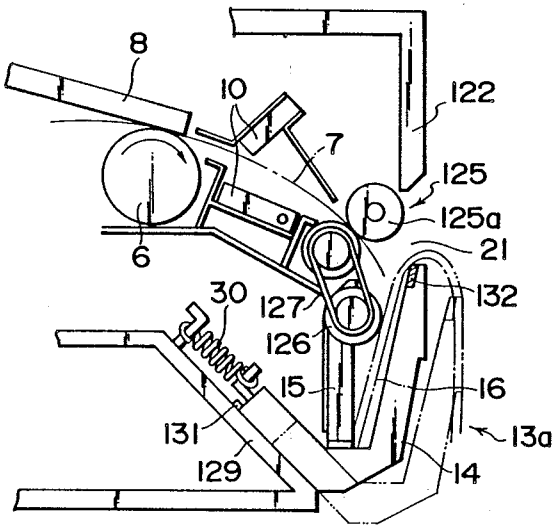

Also, in the above-described embodiment, the first guide member 14 is adapted to slide substantially horizontally on the machine body frame 129, but alternatively, as shown in FIG. 9, it may be designed to move along an inclined machine body frame 129. If this is done, the spacing between the fore end of the first guide member 14 and the pinch roller **125*b* widens each time a recording sheet 7 is received in the sheet receiving trays 13*a*, and the reversal of the trailing end of the recording sheet 7** can be accomplished easily and the occurrence of jam or the like can be decreased.

Figure 10:
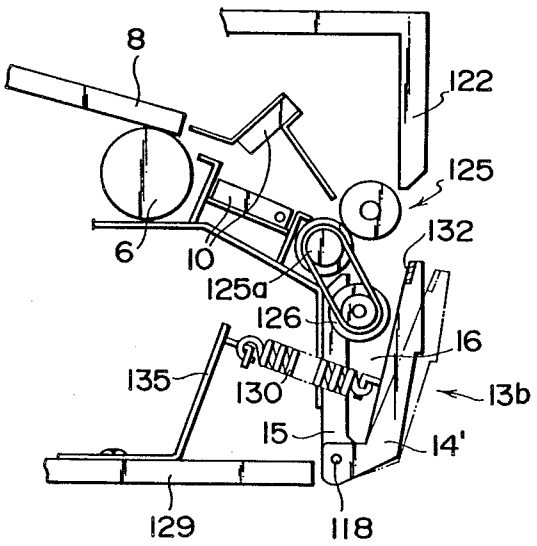

Further, in the above-described embodiment, the first guide member 14 is adapted to slide on the machine body frame 129, but alternatively, as shown in FIG. 10, a first guide member 14' may be pivotally supported on the second guide member 15 by a pin 118 and the first guide member 14' may be connected to a spring 130 restrained on a bracket 135 having one end thereof fixed to the machine body frame 129. Where this is done, each time a recording sheet 7 is received in the sheet receiving space 16, the first guide member 14' pivots clockwise about the pin 118 against the force of the spring 130, and when a receivable number of recording sheets 7 are received, the first guide member 14' pivots to a position indicated by dots-and-dash line. When all the recording sheets 7 are removed from the sheet receiving space 16, the first guide member 14' is turned to its solid line position by the spring 130.

Figure 11:
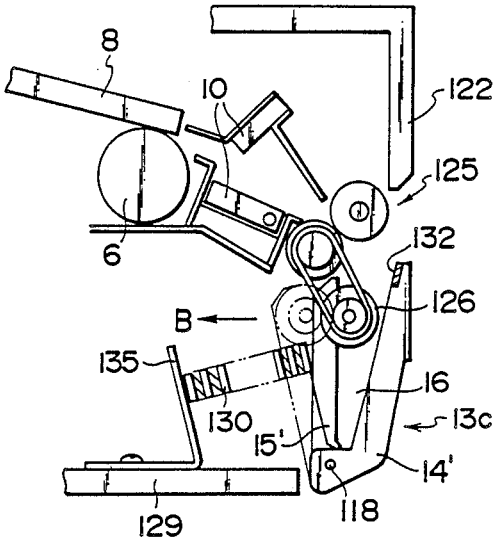

Also, as shown in FIG. 11, a first guide member 14' may be fixed and a second guide member 15' may be pivotally supported by a pin 118, and the second guide member 15' may be connected to a spring 130 having one end thereof restrained by a bracket 135 fixed to the machine body frame 129 and a grip roller 126 may be designed to move with the second guide member 15'.

Where this is done, each time a recording sheet 7 is received in the sheet receiving space 16, the second guide member 15' pivots counter-clockwise while compressing the spring 130 and the grip roller 126 moves in the direction of arrow B. When the sheet receiving space 16 is fully loaded with the recording sheets 7, the second guide member 15' and the grip roller 126 move to their positions indicated by dots-and-dash lines, and when the recording sheets 7 are removed from the space 16, the second guide member 15' and the grip roller 126 are returned to their positions by the spring 130 indicated by solid lines.

Figure 12:
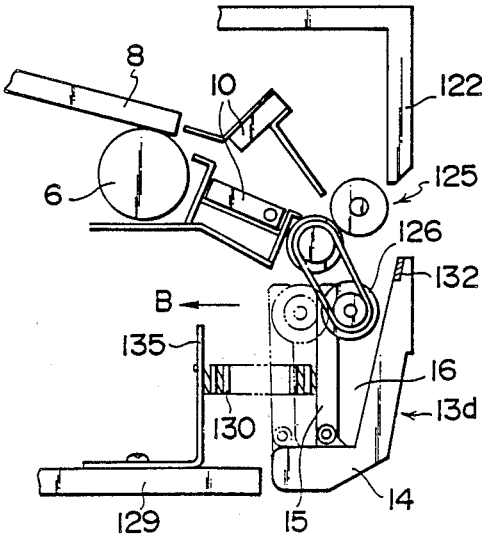

Further, as shown in FIG. 12, a second guide member 15'' may be designed to slide on the first guide member 14 and the grip roller 126 may be designed to move with the member 15'', and the guide member 15'' may be connected to a spring 130 having one end thereof restrained by a bracket 135 fixed to the machine body frame 129. Where this is done, each time a recording sheet 7 is received in the sheet receiving space 16, the second guide member 15'' moves in the direction of arrow B while compressing the spring 130, and the grip roller 126 also moves in the direction of arrow B with the guide member 15''. When the sheet receiving space 16 is fully loaded with the recording sheets, the second guide member 15'' and the grip roller 126 move to their positions indicated by dots-and-dash lines, and when the recording sheets 7 are removed from the space 16, the second guide member 15'' and the grip roller 126 are returned to their positions indicated by solid lines by the spring 130. Both of the first guide member 14 and the second guide member 15 may be designed to move.

What is claimed is:

1. A sheet receiving device having:

conveying means for conveying sheets;

first guide means for guiding the sheet downwardly;

second guide means cooperating with said first guide means to hold the sheets therebetween; and support means for movably supporting at least said first or second guide means so that the distance therebetween can increase with the sheets held therebetween, in conformity with an increase in the sheets held between said first guide means and said second guide means, without changing the posture of said first and second guide means in the direction of the thickness of the sheets held between said first and second guide means.

2. A sheet receiving device according to claim 1, wherein said conveying means conveys the sheet while nipping it.

3. A sheet receiving device according to claim 1, wherein said second guide means includes a rotational member for contacting with the sheet to impart a conveying force thereto.

4. A sheet receiving device according to claim 1, wherein said support means supports said first guide means for parallel movement.

5. A sheet receiving device according to claim 4, further having biasing means for biasing said first guide means toward said second guide means.

6. A sheet receiving device according to claim 1, wherein said first and second guide means hold a leading end edge of each sheet therebetween.

7. A sheet receiving device according to claim 6, wherein a trailing end edge of each sheet held between said first and second guide means droops downwardly from said first guide means.

8. A sheet receiving device according to claim 6, further having sheet support means for supporting the trailing end edge of each sheet above said first guide means.

9. A sheet receiving device according to claim 6, said convey means further conveying the trailing end edge of each sheet under a state in which the sheet is held between said first guide means and second guide means.

10. A sheet receiving device according to claim 9, wherein each sheet bends in conformity of conveyance of the trailing end edge of the sheet by said conveying means.

11. A sheet receiving device according to claim 6, wherein said first guide means moves parallel relative to said second guide means.

12. A sheet receiving device having:

first guide means for guiding a leading end edge of a sheet downwardly;

second guide means cooperating with said first guide means to hold the leading end edge of the sheet therebetween;

conveying means for conveying the leading end edge of the sheet to a space between said first guide means and second guide means, and conveying a trailing end edge of the sheet whose leading end edge is held between said first and second guide means to a predetermined position at which the sheet forms a loop, and thereafter releasing the sheet from conveyance; and support means for movably supporting at least said first or second guide means so that the distance therebetween can increase with the sheets held therebetween, in conformity with an increase in the sheets between said first and second guide means, without changing the posture of said first and second guide means in the direction of the thickness of the sheets held between said first guide member and said second guide means.

13. A sheet receiving device according to claim 12, wherein said second guide member includes a rotational member for contacting with the sheet to impart a conveying force thereto.

14. A sheet receiving device according to claim 12, wherein said support means slidably supports said first guide member.

15. An image forming apparatus having:

sheet receiving means for receiving sheets;

first conveying means for conveying the sheets received in said sheet receiving means;

image forming means for forming an image on the sheets conveyed by said first conveying means;

second conveying means for conveying the sheets having an image formed thereon by said image forming means downwardly;

first guide means for guiding the sheets downwardly;

second guide means for holding the sheets cooperating with said first guide means; and support means for movably supporting at least said first or second guide means so that the distance therebetween can increase with the sheets held therebetween, in conformity with an increase in the sheets held between said first and second guide means, without changing the posture of said first and second guide means in the direction of the thickness of the sheets held between said first and second guide means.

16. A sheet receiving device having:

convey means for conveying sheets;

guide means for guiding the sheets conveyed by said convey means downwardly;

a rotary member for holding the sheets cooperating with said guide means, and applying a convey force to the sheets so that the sheets are conveyed downwardly along said guiding means; and support means for movably supporting at least said guide means or rotary member so that a distance between said guide means and rotary member increases with the sheets held therebetween, in conformity with an increase in the sheets held between said guide means and rotary member.

17. A sheet receiving device according to claim 16, wherein said support means supports said guide means movable in parallel.

18. A sheet receiving device according to claim 16, wherein said support means supports said guide means rockably.

19. A sheet receiving device according to claim 16, wherein a trailing end edge of each sheet held between said guide means and rotary member droops downwardly from said guide means.

20. A sheet receiving device according to claim 16, further having sheet support means for supporting the sheet above said guide means.

21. A sheet receiving device according to claim 16, wherein said convey means further conveys the sheet under a state in which the sheet is held between said guide means and rotary member.

22. A sheet receiving device according to claim 21, wherein each sheet bends in conformity of conveyance of the trailing end edge of the sheet by said conveying means.

23. A sheet receiving device according to claim 22, wherein a trailing end edge of each sheet held between said guide means and rotary member droops downwardly from said guide means.

* * * * *

UNITED STATES PATENT AND TRADEMARK OFFICE

CERTIFICATE OF CORRECTION

PATENT NO. : 4,961,091

DATED : October 2, 1990

INVENTOR(S) : Michio Kasuya, et al.

It is certified that error appears in the above-identified patent and that said Letters Patent is hereby corrected as shown below:

[57] Abstract:

Line 4, "th" should read --the--.

Line 5, "esheet" should read --sheet--, and "th" should read --the--.

COLUMN 6:

Line 51, "duced, into the receiving space 16" should read --duced in--.

Line 52, "moving in" should read --moving into the receiving space 16--.

COLUMN 8:

Line 32, "bY" should read --by--.

Signed and Sealed this

Thirty-first Day of March, 1992

*Attest:*

HARRY F. MANBECK, JR.

*Attesting Officer*

*Commissioner of Patents and Trademarks*